US005873166A

United States Patent [19]

Page

[11] Patent Number: 5,873,166

[45] Date of Patent: Feb. 23, 1999

[54] COMBINATION CIGAR CUTTER AND MONEY CLIP DEVICE

[76] Inventor: Thomas A. Page, 322 Chapel Belle, Houston, Tex. 77024

[21] Appl. No.: 676,566

[22] Filed: Jul. 8, 1996

Related U.S. Application Data

[60] Provisional application No. 60/000,910 Jul. 6, 1995.

[51] Int. Cl.[6] ..... A24C 5/12

[52] U.S. Cl. ..... 30/113; 30/111

[58] Field of Search ..... 30/109, 111, 113, 30/123, 124, 136, 142, 143

[56] References Cited

U.S. PATENT DOCUMENTS

| | | | |
|---|---|---|---|
| 837,018 | 11/1906 | Wentz | 30/113 |
| 1,089,107 | 3/1914 | Blood | 30/111 |
| 1,119,220 | 12/1914 | Bates | 30/113 |
| 1,706,581 | 3/1929 | McFarland | 30/113 |
| 4,447,950 | 5/1984 | Mizelle | 30/155 |

FOREIGN PATENT DOCUMENTS

| | | | |
|---|---|---|---|
| 662328 | 3/1933 | Germany | 30/111 |

*Primary Examiner*—Hwei-Siu Payer
*Attorney, Agent, or Firm*—Mark A. Oathout

[57] ABSTRACT

The present invention generally relates to a combination cigar cutter with a money clip and includes an ornamental design for the same. The device generally includes a front plate and a back plate separated by spacers and housing a blade. The back plate also incorporates a money clip.

3 Claims, 3 Drawing Sheets

COMBINATION CIGAR CUTTER AND MONEY CLIP DEVICE

This is a utility application based upon Provisional Application No. 60/000,910, filed Jul. 6, 1995.

SUMMARY OF THE INVENTION

The present invention generally relates to a combination cigar cutter with a money clip and includes an ornamental design for the same. The device generally includes a front plate and a back plate separated by spacers and housing a blade. The back plate also incorporates a money clip.

DETAILED DESCRIPTION OF THE INVENTION

Figure 1:
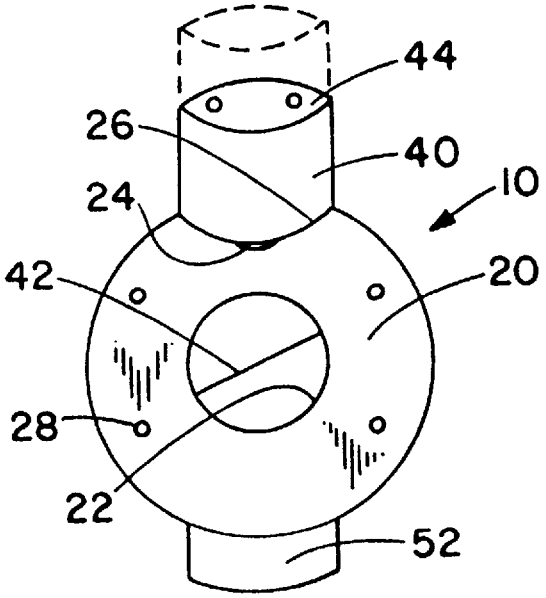
FIG. 1 is a front view of the invention showing the blade partially open.
Figure 3:
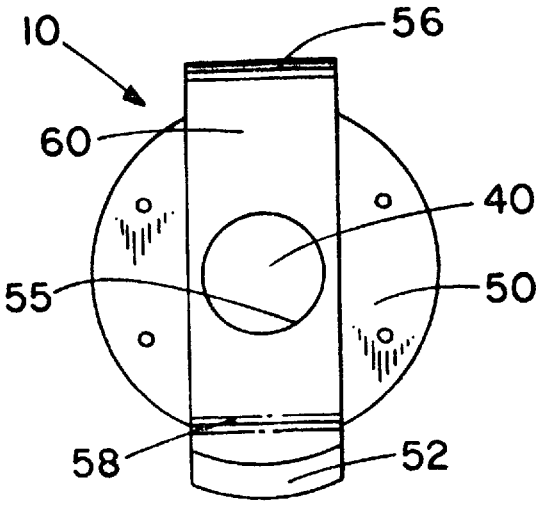
FIG. 3 is a back view of the invention.
Figure 2:
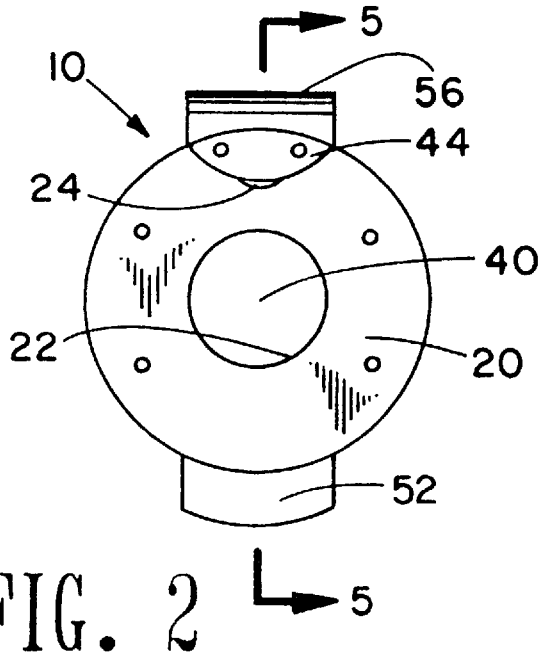
FIG. 2 is a front view of the invention with the blade closed.
Figure 4:
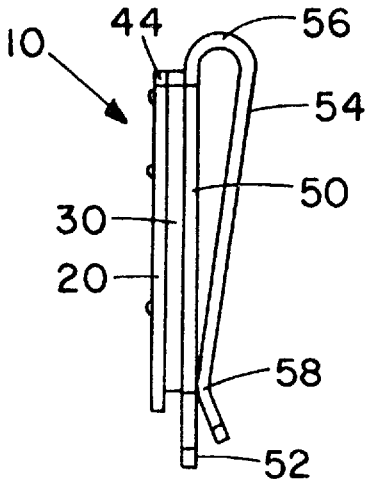
FIG. 4 is a side view of the invention.

Referring to FIGS. 1–6, the present invention relates to a combination cigar cutter and money clip 10. The combination guillotine cigar cutter and money clip 10 generally shown includes a front plate 20, spacers 30, 34 and 38, a blade 40 and a back plate 50.

The front plate 20 is generally annular shaped and defines a central opening 22, a detent 24 and an arcuate cutout 26.

The first spacer 30 and second spacer 34 are generally crescent shaped. The third spacer 38 is generally trapezoidal shaped.

Blade 40 generally includes a cutting edge 42 which may run diagonal from one side of the blade 40 to the other side. The blade 40 also includes a handle 44 which as shown is a small eye-shaped strip secured to blade 40. The blade 40 also defines a step 46.

Back plate 50 is generally annular shaped and includes a lip 52 which extends from one end and a strip 54 which extends from the other end. The strip 54 includes a first bend 56 and a second bend 58 to form a money clip 60 in conjunction with the back plate 50 and lip 52. The back plate 50 defines a central opening 51 and the strip 54 also defines a central opening 55.

Different shapes of, for example front plate 20, back plate 50, and spacers 30, 34 and 38 can be employed in the overall design to achieve an aesthetically pleasing product.

Figure 5:
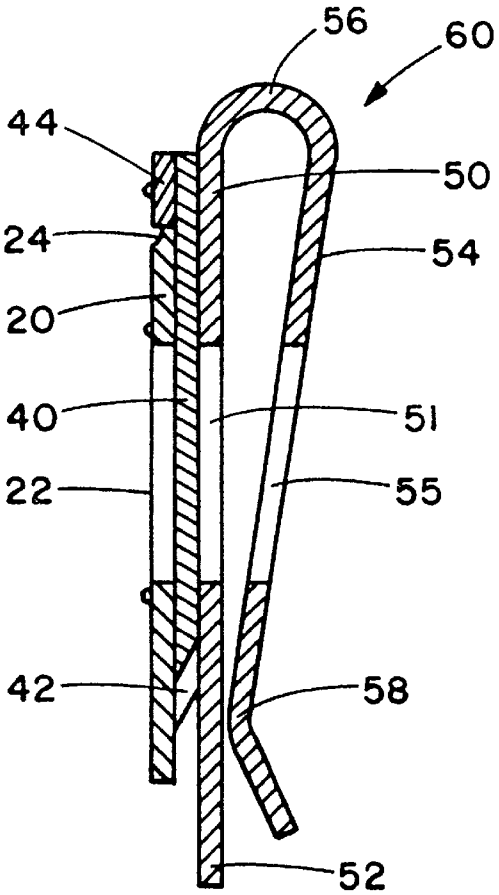
FIG. 5 is a sectional view taken along line 5—5 of FIG. 2.

As best seen in FIG. 5, the central openings 22, 51 and 55 are aligned and are of sufficient diameter to allow the passage or insertion of a cigar (not shown).

Figure 6:
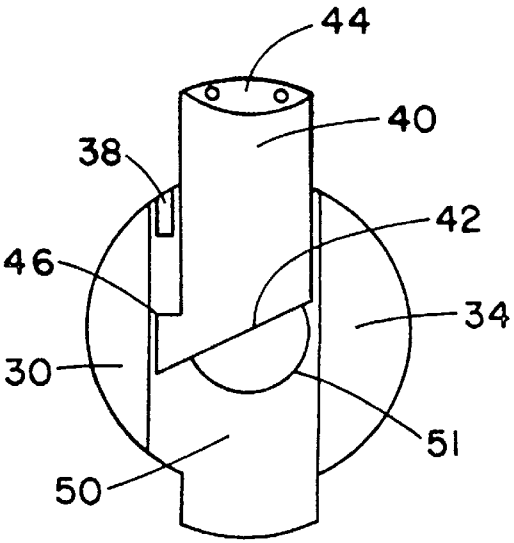
FIG. 6 is a front view of the invention similar to FIG. 1 with the front plate removed.

First spacer 30, second spacer 34 and third spacer 38 are sandwiched between front plate 20 and back plate 50 and all are secured together by pins 28, screws or other suitable securing means. The blade 40 is also placed between front plate 20 and back plate 50 and between first spacer 30 and second spacer 34. The blade 40 can be grasped at handle 44 via detent 24 and slid between front plate 20 and back plate 50. However, the blade 40 is prevented from being removed via step 46 which will catch on the third spacer 38 (as best seen in FIG. 6) once the blade 40 is retracted to a sufficient position such that central openings 22, 51 and 55 are unobstructed by the cutting edge 42. At this position a cigar can be inserted into the combination guillotine cigar cutter and money clip 10 and the cutting edge 42 can be lowered to sever a cigar. The money clip 60 functions as other known money clips.

The preferred embodiment of the invention has been shown and described. Various departures can be made from this preferred embodiment without departing from the spirit of the invention as described.

What is claimed is:

1. An apparatus for cutting a cigar and for clipping a quantity of money including:

a cigar cutter wherein said cigar cutter comprises:

a front plate having an arcuate cutout and a detent at an upper end;

a back plate;

a first, and a second spacer which separate said front plate and said back plate;

wherein said front plate, said back plate, said first spacer, and said second spacer define a central opening and a blade passage transverse to the central opening;

a blade mounted in the blade passage having a handle on one end of the blade, a cutting edge on the other end and a step;

wherein said blade is slidable from a first position where the central opening is unobstructed and said step abuts said first spacer to a second position for severing the cigar; and a money clip integral with said back plate, wherein said money clip defines a central opening aligned with the central opening through said front plate and said back plate.

2. The apparatus according to claim 1 wherein said cutting edge is diagonal from one side of said blade to the other side.

3. An apparatus for cutting a cigar and for clipping a quantity of money including:

a cigar cutter wherein said cigar cutter comprises a front plate and a back plate separated by at least one spacer wherein said front plate, said back plate, and said spacer define a central opening and a blade passage transverse to the central opening;

a blade mounted in the blade passage and slidable from a first position where the central opening is unobstructed to a second position where the cigar is severed; and a money clip adjoined to said back plate, wherein said money clip defines a central opening aligned with the central opening through said front plate, said back plate and said spacer.

* * * * *